US009866976B2

(12) United States Patent
Riis et al.

(10) Patent No.: US 9,866,976 B2
(45) Date of Patent: Jan. 9, 2018

(54) HEARING AID SYSTEM WITH AN ALIGNED AUDITORY PERCEPTION

(71) Applicant: OTICON MEDICAL A/S, Smørum (DK)

(72) Inventors: Søren K. Riis, Smørum (DK); Klaus L. Svendsen, Smørum (DK)

(73) Assignee: OTICON MEDICAL A/S, Smørum (DK)

( * ) Notice: Subject to any disclaimer, the term of this patent is extended or adjusted under 35 U.S.C. 154(b) by 100 days.

(21) Appl. No.: 14/991,361

(22) Filed: Jan. 8, 2016

(65) Prior Publication Data

US 2016/0205483 A1 Jul. 14, 2016

(30) Foreign Application Priority Data

Jan. 13, 2015 (EP) ..... 15150882

(51) Int. Cl.
*H04R 5/00* (2006.01)
*H04R 25/00* (2006.01)

(52) U.S. Cl.
CPC ..... *H04R 25/558* (2013.01); *H04R 25/40* (2013.01); *H04R 25/505* (2013.01); *H04R 25/552* (2013.01); *H04R 25/70* (2013.01); *H04R 2225/41* (2013.01); *H04R 2225/43* (2013.01); *H04R 2225/55* (2013.01)

(58) Field of Classification Search
CPC .... H04R 25/552; H04R 25/70; H04R 25/505; H04R 2225/43; H04R 25/558; H04R 2225/41; H04R 2225/55; H04R 25/40
USPC ..... 381/23.1
See application file for complete search history.

(56) References Cited

U.S. PATENT DOCUMENTS

| | | | | |
|---|---|---|---|---|
| 6,768,802 | B1 | 7/2004 | Baechler | |
| 2004/0013280 | A1 | 1/2004 | Niederdrank | |
| 2009/0030484 | A1 | 1/2009 | Chambers | |
| 2010/0111338 | A1* | 5/2010 | Ypma | H04R 25/552 381/314 |
| 2013/0094683 | A1 | 4/2013 | Hansen | |

* cited by examiner

*Primary Examiner* — Paul S Kim
(74) *Attorney, Agent, or Firm* — Birch, Stewart, Kolasch & Birch, LLP

(57) ABSTRACT

According to an embodiment, a hearing aid system is disclosed. The system includes a first auditory unit and a second auditory unit, where each unit is configured to be worn by a user. The first auditory unit provides a first auditory perception to the user and utilizes a first working principle. The second auditory unit provides a second auditory perception to the user and utilizes a second working principle. The first auditory unit and/or the second auditory unit are configured to process a related parameter value, received from the user, for a parameter. The processing of the related parameter value results in obtaining an aligned auditory perception between the first auditory perception and the second auditory perception.

15 Claims, 6 Drawing Sheets

HEARING AID SYSTEM WITH AN ALIGNED AUDITORY PERCEPTION

FIELD

The disclosure relates to a hearing aid system. More particularly, the disclosure relates to the hearing aid system where an aligned auditory perception between a first auditory perception produced by a first auditory unit and a second auditory perception produced by a second auditory unit is obtained.

BACKGROUND

Directional hearing is the ability of a person to distinguish the direction in which a sound source is located. The ability to localize sounds is highly dependent on being able to perceive sounds in both ears. When sounds are inaudible in one ear, localization becomes very difficult. Reduced localization may lead to reduced safety, and difficulties in social functioning.

Further, listening with two ears enables a person to understand more when speech occurs in a noisy environment. This is because binaural hearing enhances speech understanding in noise because of several factors such as head diffraction, binaural squelch, and binaural redundancy. The head diffraction effect causes the signal-to-noise ratio (SNR) to be greater at one ear than the other when the noise and target speech arrives from different directions. Even when the same signal and noise reach both ears, the brain may combine both inputs to produce more salient central representations of the speech signal (binaural redundancy) than if only input from one ear is available. The brain may also make use of the inter-aural time and inter-aural level differences to at least partially reduce deleterious effects of noise (binaural squelch).

A person having severe to profound hearing loss in both ears but wears a cochlear implant in only one ear is an illustrative example where the person may experience considerable hearing deficits in localization and speech intelligibility. However, for unilateral cochlear implant users who have residual hearing in the non-implanted ear, it is possible to provide binaural hearing and take advantage of sound perception in both ears by fitting a hearing aid providing acoustic amplification to the ear with residual hearing. Thus, a bimodal hearing aid system is used where electrical stimulation on one ear is supplemented with acoustic amplification at the other ear having residual hearing.

These auditory units, i.e. cochlear implant and hearing aid providing acoustic amplification, are typically developed more or less independently without the possibility of their combined use being taken into account. These auditory units are usually also fitted separately, i.e. for fitting the auditory units to the recipient (user), different professionals separately and independently adjust parameters of each of the auditory unit at different clinics. These adjustments usually depend on features associated with the individual unit, hearing characteristics of individual ear of the recipient (user), along with different skills and judgment of the professionals. This commonly results in different loudness growth levels with respect to the two ears and distorted cue transmission. This may potentially lead to decreased wearing comfort and sub-optimal performance of the bimodal hearing aid system because ensuring a good binuaral loudness balance and optimal binaural cue transmission is basis for obtaining good localization ability and good speech recognition. Thus, the way these units are fitted are not optimal for their combined use in the hearing aid system.

Current bimodal fitting method has inherent challenges when trying to align loudness and ensuring undistorted binaural cue transmission. These challenges may include at least one or more of i) difference in loudness growth functions between electrically and acoustically stimulated hearing, ii) place mismatch, i.e. misalignment between respective mapping of acoustics to the auditory nerve in an acoustic hearing aid compared to the cochlear implant, iii) different electric and acoustic compression, iv) temporal asynchrony, i.e. total frequency-dependent delay of the electric path compared to the acoustic path because of processing in the CI and acoustic hearing aid before the auditory nerve is activated, v) brain plasticity implying that many of these psychoacoustic aspects changes over time after CI implantation and static fitting may not be optimal over a period of time, and vi) other individual differences such as changed acoustic loss on the ear with residual hearing loss and/or pathology on the ear with implanted cochlear implant.

Because it is very difficult to both measure and compensate for all these variation in a practical fitting situation, there exists a need to provide an efficient, easy to use and cost-effective solution that addresses at least some of the above-mentioned problems.

SUMMARY

According to an embodiment, a hearing aid system is disclosed. The system includes a first auditory unit configured to be worn by a user and providing a first auditory perception to the user. The system also includes a second auditory unit configured to be worn by the user and providing a second auditory perception to the user. The first auditory unit utilizes a first working principle, whereas the second auditory system utilizes a second working principle. The first auditory unit and/or the second auditory unit are configured to process a related parameter value, received from the user, for a parameter such that an aligned auditory perception between the first auditory perception and the second auditory perception is obtained.

For a particular parameter, the first auditory perception is based on a first parameter value and the second auditory perception is based on a second parameter value. In known arts, the first parameter value and second parameter value for the parameter are typically unrelated to each other. In an embodiment of the disclosure, the user may establish a relationship between the first parameter value and the second parameter value and such relationship is expressed in the related parameter value. The choice of the related parameter value for the particular parameter is dependent upon user's perception of optimal performance of the first auditory unit and the second auditory unit in combination. For example, the optimal performance includes binaural loudness balance and/or optimal binaural cue transmission for obtaining good localization ability and good speech recognition. Therefore, in one embodiment, the related parameter value defines a relative adjustment between a first parameter value of the parameter associated with the first auditory perception and a second parameter value of the parameter associated with the second auditory perception. In another embodiment where the parameter is only associated with one of the auditory units, the user may adjust the parameter value for the auditory unit with which the parameter is associated with in such a manner that good localization ability and good speech intelligibility is obtained based on binaural loudness balance and/or optimal binaural cue transmission between the first auditory perception and the second auditory perception.

In one embodiment where the parameter is associated with both the first auditory perception and the second auditory perception, the aligned auditory perception refers to user's auditory perception based on the first parameter value and the second parameter value that are relatively adjusted using the related parameter value, thereby achieving an inter-related first auditory perception (iFAP) and second auditory perception (iSAP). In another embodiment where the parameter is only associated with one of the auditory units, the aligned auditory perception refers to adjustment of the one of the auditory perception associated with the parameter such that the user perceives a binaural loudness balance and/or optimal binaural cue transmission.

The term adjust or other variation of this terms such as adjusting in relation to the first auditory unit and/or second auditory unit refer to making electronic and/or software changes in the auditory unit(s) to operate the auditory unit(s) with a changed output characteristics relative to pre-adjustment.

In different embodiments, the first working principle and the second working principle may be selected from a group consisting of electrical stimulation, mechanical stimulation, acoustic stimulation, optical stimulation, and a combination thereof. This may include using cochlear implants, bone conduction hearing aid, hearing aid capable of stimulating cochlea using light, hearing aid capable of providing acoustic stimulation, and combination such as in an electro-acoustic hybrid stimulation as the first auditory unit and/or the second auditory unit.

The first auditory unit and the second auditory unit may be worn at different ears of the user. For example, a cochlear implant is fitted in one ear and a hearing aid providing acoustic amplification is fitted in another ear having a residual hearing, such as in a bimodal stimulation. In an alternative embodiment, the first auditory unit may include a combination of working principles. For example, both a cochlear implant and a hearing aid providing acoustic amplification is fitted in a user ear having the residual hearing, such as in a hybrid stimulation and the second auditory unit utilizing any of the working principles listed above may be worn at another ear of the user.

In one embodiment, the first working principle and the second working principle are the same. For example, both the first auditory unit worn on one ear and the second auditory unit on another ear may each utilize hybrid stimulation. In another embodiment, the first working principle and the second working principle are different. For example, in one implementation the first auditory unit is a cochlear implant worn at one ear and the second auditory unit is a hearing aid providing acoustic amplification. In another implementation, the first auditory unit is a cochlear implant and the second auditory unit is a bone conduction hearing aid. In yet another implementation, a first auditory unit utilizing hybrid stimulation and the second auditory unit is cochlear implant. Other combinations are also within the scope of this disclosure.

In an embodiment, the first working principle and the second working principle are partially different. Some illustrative examples include, a first auditory unit utilizes hybrid stimulation and a second auditory unit is a cochlear implant or a first auditory unit utilizes hybrid stimulation and second auditory unit is a hearing aid providing acoustic stimulation. Other such combinations will be apparent to the person skilled in the art.

The disclosed solution is preferable when the first working principle and the second working principle are either different or partially different such as the first auditory unit utilizes the hybrid stimulation whereas the second auditory unit utilizes an acoustic stimulation or electrical stimulation.

The skilled person would realize that a number of combinations of auditory units with same or partially different or different working principle with the auditory units being worn on same ear or different ears are possible.

In different embodiments, the term "worn" may refer to i) partially implanted cochlear implant with non-implanted speech processor or fully implanted cochlear implant with implanted speech processor, and/or ii) percutaneous or transcutaneous bone conduction hearing aid, and/or iii) hearing aid providing acoustic stimulation that are one of the Behind-the-Ear type, In-the-Ear type, In-the-Canal type or Completely-in-Canal type hearing aids, and/or iv) percutaneous or transcutaneous optical stimulation based hearing aid. The term worn may also include a combination of the these embodiments, for example, in a hybrid stimulation, the first auditory unit may include a partially implanted cochlear implant combining electrical stimulation for high frequency sound and a hearing aid providing acoustic stimulation for low frequency sound in the same ear.

In one embodiment, the first auditory unit and the second auditory unit share a common signal processing unit. The common signal processing unit may be adapted to receive signals from respective microphones of the first auditory unit and a second auditory unit, and process the received microphone signals. In another embodiment, the first auditory unit comprises a first processing unit and the second auditory unit comprises a second processing unit, the first processing unit being different from the second processing unit. The first processing unit may be configured to receive and process a first microphone signal received at a first microphone of the first auditory unit. The second processing unit may be configured to receive and process a second microphone signal received at a second microphone of the second auditory unit. The first and second processing units may be communicatively connected to each other.

In one embodiment, the first auditory unit is configured to receive a first command from the user and to process the first command. Additionally or alternatively, the second auditory unit is configured to receive a second command from the user and to process the second command. Additionally or alternatively, a remote control is in a communicative link with the first auditory unit and/or second auditory unit. The remote control is configured to receive the first command and/or second command from the user and to transmit the first command and/or second command to the first auditory unit and/or second auditory unit respectively. In these recited embodiments, the processing of the first command and/or second command generates the aligned auditory perception.

Thus, the first auditory unit and/or the second auditory unit may include interactive input module like buttons or touch panel to receive the first command and/or the second command from the user. In case the remote control is used to input the first command and/or the second command, such user command may be provided on a user interface included in the remote control. In an embodiment, the remote control is a smartphone running a mobile app, which is configured to control the parameter of the first auditory unit and/or the second auditory unit. The smartphone is configured to communicate with the first auditory unit and/or the second auditory unit and includes user interface to receive the first command and the second command from the user. Other device such as tablet, laptop, or other such device having an application capable of controlling parameters may also be used as the remote control.

In one embodiment, the first command includes the related parameter value and a first instruction set. The first instruction set is adapted to be executed by a signal processing unit associated with the first auditory unit. The execution of the first instruction set adjusts the first parameter value with respect to the second parameter value by the related parameter value or adjusts only the first parameter value if the parameter is associated only with the first auditory unit, the adjustment resulting in the aligned auditory perception.

Alternatively, in another embodiment, the second command includes the related parameter value and a second instruction set. The instruction set is adapted to be executed by a signal processing unit associated with the second auditory unit. The execution of the second instruction set adjusts the second parameter value with respect to the first parameter value by the related parameter value or adjusts only the second parameter value if the parameter is associated only with the second auditory unit, the adjustment resulting in the aligned auditory perception.

In yet another alternative embodiment, the first command includes a first part of the related parameter value and a first instruction set. The first instruction set is adapted to be executed by a signal processing unit associated with the first auditory unit. The second command includes a second part of the related parameter value and a second instruction set. The second instruction set is adapted to be executed by a signal processing unit associated with the second auditory unit. The execution of the first instruction set adjusts the first parameter value by the first part of the related parameter value and the execution of the second instruction set adjusts the second parameter value by the second part of the related parameter value. The first part of the related parameter and the second part of the related parameter value produces an effective adjustment that equals to the related adjustment produced by the related parameter value between the first parameter value and the second parameter value.

The parameter includes features that characterize the performance of the first auditory unit and the second auditory unit, the features being capable of influencing localization ability and/or speech recognition from an audio signal. For example, the parameters is selected from a group consisting of loudness parameter associated with the audio signal like gain or level of stimulation, frequency dependent gain, delay in delivering electrical/mechanical/acoustic stimulation based on the audio signal, and a combination thereof. Other parameters may also be controlled such as noise reduction parameter, a microphone direction parameter, a microphone sensitivity parameter, a program selection parameter, a pitch parameter, a timbre parameter, a sound quality parameter, a most comfortable current level, a threshold current level, a channel acoustic gain parameter, a dynamic range parameter, a pulse rate value, a pulse width value, a pulse shape, a frequency parameter, an amplitude parameter, a waveform parameter, an electrode polarity parameter (i.e., anode-cathode assignment), a location parameter (i.e., which electrode pair or electrode group receives the stimulation current), stimulation type parameter (i.e., monopolar, bipolar, or tripolar stimulation), burst pattern parameter (e.g., burst on time and burst off time), a duty cycle parameter, a spectral tilt parameter, a filter parameter, and a dynamic compression parameter.

In different embodiments, the related parameter value is established for different scenarios. The different scenarios are selected from a group consisting of different sound environment, different locations, different events, different audio frequencies, different audio frequency ranges, or a combination thereof.

In an illustration, different sound environments may include quiet, medium or loud sound environments. These environment classification may be based on average signal level, for example quiet may be defined by 50 dB SPL, medium by 60 dB SPL and loud by 70 dB SPL and above. Other signal level values and environment classification may also be used to define these sound environments. The average signal level may be calculated based on the audio signal that the remote control and/or the first auditory unit and/or second auditory unit picks up. The sound environment may also include conflicting sound environment such as "cocktail party" environment, where a target sound is mixed with a number of acoustic interferences. In different illustration, geographic coordinates of a location may define different locations, for example house coordinates, office coordinates, school coordinates, etc. In different illustrations, audio frequency ranges may include 195 Hz to 846 Hz, 846 Hz to 1497 Hz, 1497 Hz to 3451 Hz, 3451 Hz to 8000 Hz, and so on. Other frequency ranges are also within the scope of this disclosure. In different embodiments, different events may include scenarios such as the user is attending lecture, attending a musical concert, watching television, driving with a passenger on side and/or back seat. Many other events may be contemplated and within the scope of this disclosure. It is also conceivable that some of these scenarios are combined, for example a scenario may include defining specific frequency range dependent related parameter value when the user is attending lecture, etc.

The user may enter the first command and/or the second command and the processing unit associated with the first auditory unit and/or the processing unit associated with second auditory unit and/or the remote control may be configured to use the related parameter value, associated with the first command and/or the second command, for a parameter and the scenario to create the look-up table. Therefore, in one embodiment, the processing unit associated with the first auditory unit is adapted to generate a look-up table comprising a mapping between a scenario and a related parameter value for at least one parameter. Additionally or alternatively, the processing unit associated with the second auditory unit is adapted to generate a look-up table comprising a mapping between a scenario and a related parameter value for at least one parameter. Additionally or alternatively, the remote control may be adapted to generate a look-up table comprising a mapping between a scenario and a related parameter value for at least one parameter.

In an embodiment, for an entered related value, the user may define the scenario. For example, the user defines the location to be home or the environment to be loud or being in a lecture room along with associated related parameter value for a parameter. The user may also perform additional self-test such as generating a sound of a particular level and frequency from a sound source, which is positioned at a certain spatial relation with respect to the first auditory unit and second auditory unit. Thereafter, based on the first auditory perception and second auditory perception of the sound, the user may define a related parameter value for a parameter relating to the scenario, which may also include frequency ranges, to obtain aligned auditory perception.

Additionally or alternatively, for an entered related value, the scenario may automatically be defined by the first auditory unit and/or the second auditory unit and/or the remote control. For example, Global Positioning System (GPS) of the remote control may define the location, average signal level as picked up by microphones of the first auditory unit and/or second auditory unit and/or remote control defines the environment, the analysis of signal picked by microphones of the first auditory unit and the second auditory units may define frequency components/ranges of the incoming signal.

In different embodiments, the first auditory unit includes a first memory and/or second auditory unit includes a second memory and/or the remote control includes a remote memory. The remote memory may include a storage module physically included in the remote control and/or a storage module that is only communicatively connected to the remote control, such as a wirelessly connected database or cloud storage. One of more of the first memory and/or the second memory and/or the remote memory is configured to store the look up table.

In one embodiment, the user may identify the scenario in which the user wearing the first auditory unit and the second auditory unit is present. Based on the identification, the user may manually access the look up table and manually select the related parameter value. In one embodiment, the related parameter value is provided to the first auditory unit and/or the second auditory unit and relative adjustment between the first parameter value and the second parameter value for a parameter is made such that an aligned auditory perception is achieved. Additionally or alternatively, where the parameter is only associated with one of the auditory units, the related parameter value is provided to the auditory unit associated with the parameter and an aligned auditory perception is obtained.

In another embodiment, the processing unit associated with the first auditory unit and/or the second auditory unit and/or the remote control is configured to detect a scenario for the first auditory unit and the second auditory unit. This may be achieved based on analysis of incoming signal at the microphone of the first auditory unit and/or second auditory unit, for example in order to determine frequency ranges, sound environment, etc. Other detection techniques such as utilizing GPS of the remote control are also within the scope of the disclosure. In response to the detected scenario, the stored related parameter value from the look-up table is accessed. Lastly, in one embodiment, the accessed related parameter value is utilized to adjust the first parameter value relative to the second parameter value for a parameter such that the aligned auditory perception is obtained. The utilization step may include providing the accessed related parameter value to the first auditory unit and/or the second auditory unit and executing the instruction set associated with the related parameter value in order to make the relative adjustment. Additionally or alternatively, where the parameter is only associated with one of the auditory units, the related parameter value is provided to the auditory unit associated with the parameter and an aligned auditory perception is obtained by adjusting the parameter in the auditory unit provided with the related parameter value.

According to another embodiment, a method for operating a hearing aid system is disclosed. The method includes receiving, from a user, a related parameter value for a parameter at a first auditory unit and/or a second auditory unit. Thereafter, the received related parameter value is processed at the first auditory unit and/or the second auditory unit such that an aligned auditory perception between a first auditory perception produced by the first auditory unit and a second auditory perception produced by the second auditory unit is obtained. The related parameter value may define a relative adjustment between a first parameter value associated with the first auditory perception and a second parameter value associated with the second auditory perception.

Additionally or alternatively, where the parameter is only associated with one of the auditory units, the related parameter value may define adjusting the parameter value of the auditory unit associated with the parameter such that the aligned auditory perception is obtained.

In one embodiment, the received related parameter is received based on manual input from a user. The manual input may include entering the related parameter value for a parameter or selecting the scenario with or without parameter selection from the look up table, resulting in the related parameter value associated with the selected scenario to be received at the first auditory unit and/or second auditory unit. The user may selectively choose one or more parameter for a selected scenario which are received at the auditory unit(s). Alternatively, the received related parameter is received automatically in dependence on access of the related parameter value from a look up table based on scenario detection.

In different combinable or alternative embodiments, the elements of the system may perform method steps that reflect functioning of these elements, as disclosed in the preceding paragraphs.

BRIEF DESCRIPTION OF ACCOMPANYING FIGURES

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other embodiments. These and other embodiments, features and/or technical effect will be apparent from and elucidated with reference to the illustrations described hereinafter in which:

DETAILED DESCRIPTION

Figure 1:
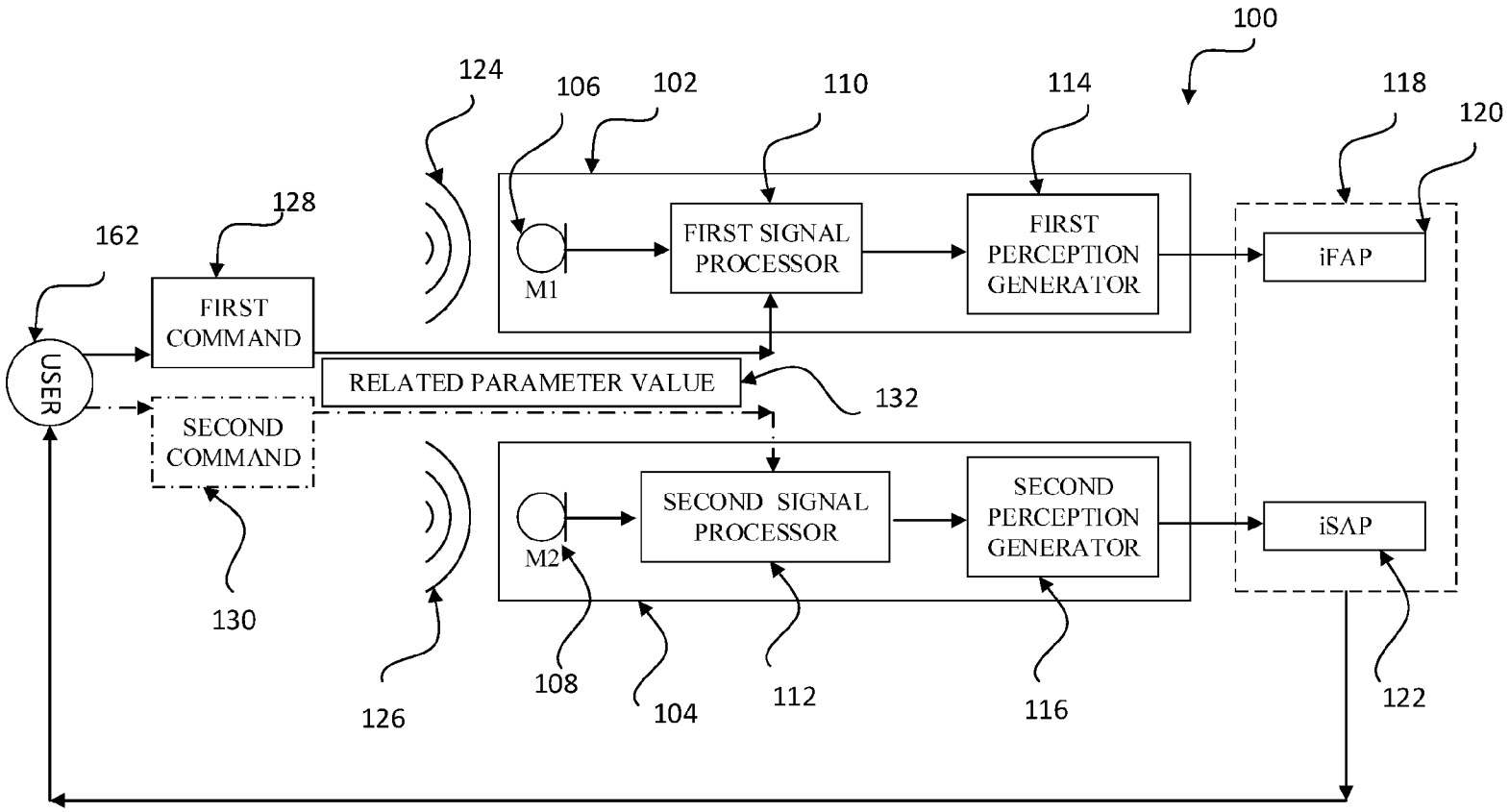
FIG. 1 illustrates a hearing aid system for producing an aligned auditory perception according to an embodiment.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, steps, processes, etc. (collectively referred to as "elements"). Same elements in different figures are provided with same reference numeral.

The auditory unit is configured to improve or augment the hearing capability of a user by receiving an acoustic signal from a user's surroundings, generating a corresponding audio signal, possibly modifying the audio signal and providing the possibly modified audio signal as an audible signal as an auditory perception to the user. In different embodiments, such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The first auditory unit and the second auditory unit may form a binaural hearing system, where the first auditory unit and the second auditory unit are communicatively coupled and, in cooperation, provide audible signals to both of the user's ears.

In general, the auditory unit includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

FIG. 1 illustrates a hearing aid system 100 for producing an aligned auditory perception according to an embodiment. The system includes a first auditory unit 102 and a second auditory unit 104. The first auditory unit includes a microphone 106 that receives sound 124 and configured to generate a first microphone signal. A first signal processor 110 is configured to process the first microphone signal. A first perception generator 114 is configured to generate a first auditory perception in dependence on the processed first microphone signal. The second auditory unit 104 includes a microphone 108 that receives sound 126 and configured to generate a second microphone signal. A second signal processor 112 is configured to process the second microphone signal. A second perception generator 116 is configured to generate a second auditory perception in dependence on the processed second microphone signal.

In an embodiment, the microphone may include directional microphone systems configured to enhance a target acoustic source among a multitude of acoustic sources in the local environment of the user wearing the first auditory unit and the second auditory unit. In an embodiment, the directional system is adapted to detect (such as adaptively detect) from which direction a particular part of the microphone signal originates.

Depending upon the working principle of the first auditory unit and the second auditory unit, the processing of the microphone signal may vary based on manipulation of the parameter. The processing of the microphone signal in an auditory unit is well known in the art. For example, the auditory unit(s) may be configured to provide a frequency dependent gain and/or a level dependent compression and/or a transposition (with or without frequency compression) of one or frequency ranges to one or more other frequency ranges, e.g. to compensate for a hearing impairment of a user.

Depending upon the working principle of the first auditory unit and the second auditory unit, the perception generator may include a number of electrodes of a cochlear implant or a vibrator of a bone conducting hearing device or a loudspeaker of a hearing aid providing acoustic stimulation.

In order to produce the aligned auditory perception 118, i.e. interrelated first auditory perception 120 and second auditory perception 122, a user 162 wearing the first auditory unit and the second auditory unit may provide a first command 128 to the first auditory unit 102. The first command includes the related parameter value 132 and a first instruction set. The first instruction set is adapted to be executed by a signal processing unit 110 associated with the first auditory unit 102. The execution of the first instruction set adjusts a first parameter value with respect to a second parameter value by the related parameter value and an aligned auditory perception 118 is obtained.

Alternatively, in order to produce the aligned auditory perception 118, i.e. interrelated first auditory perception 120 and second auditory perception 122, the user 162 wearing the first auditory unit and the second auditory unit may provide a second command 130 to the second auditory unit 104. The second command includes the related parameter value 132 and a second instruction set. The second instruction set is adapted to be executed by a signal processing unit 112 associated with the second auditory unit. The execution of the second instruction set adjusts the second parameter value with respect to the first parameter value by the related parameter value and an aligned auditory perception 118 is obtained.

In another embodiment where the parameter is only associated with one of the auditory units, the aligned auditory perception 118 is obtained by adjusting one of the auditory perception associated with the parameter such that the user perceives a binaural loudness balance and/or optimal binaural cue transmission. For example, if the parameter is associated only with the first auditory unit 102, the user provides the first command 128 to the first auditory unit 102, which adjusts its parameter value in accordance with the received related parameter value 132 and allows for producing the aligned auditory perception 118.

In this embodiment, the first auditory unit 102 and the second auditory unit 104 may be communicatively connected (not shown) to each other. Such communication may be either wired based or wireless.

Figure 2:
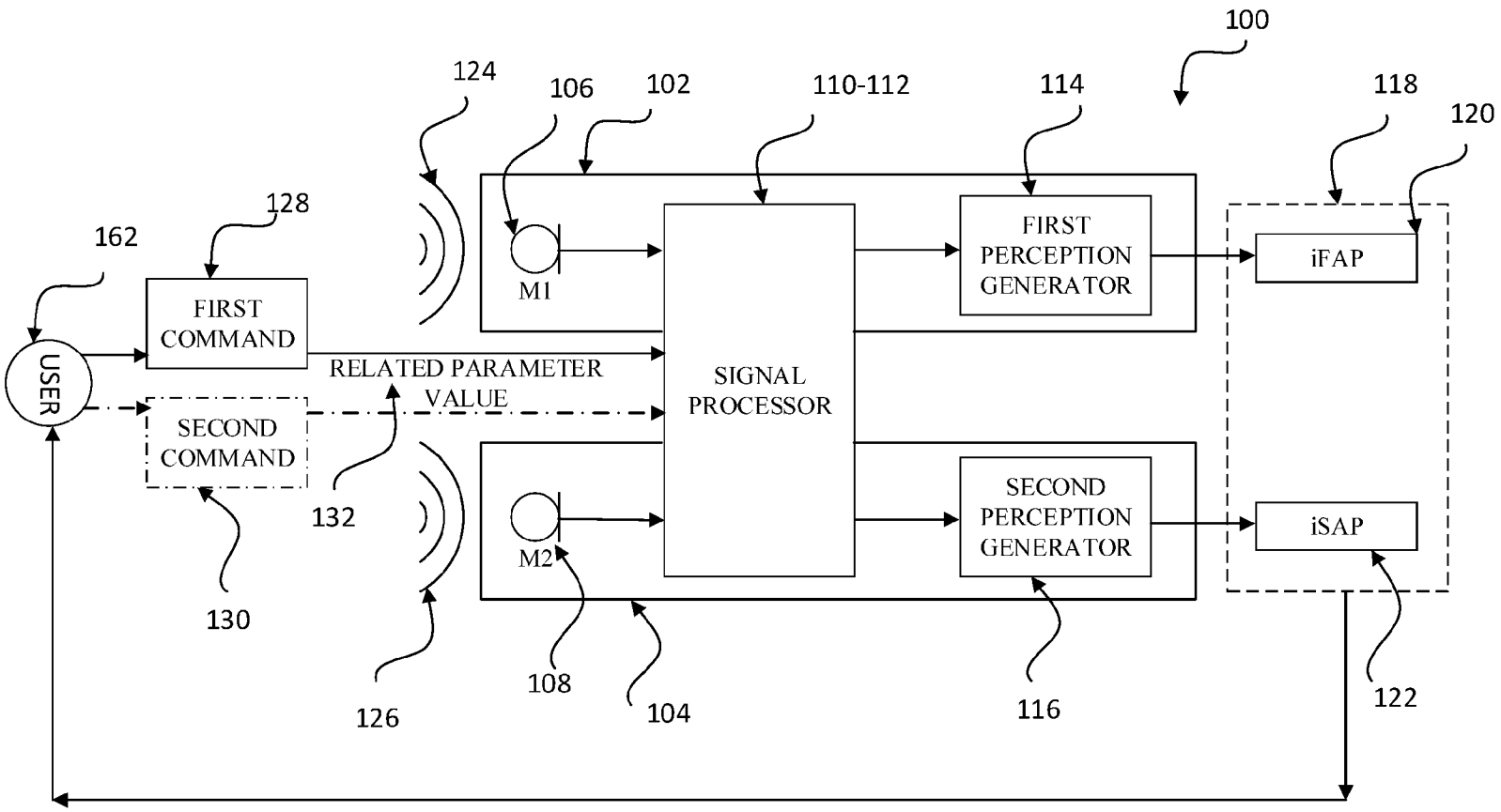
FIG. 2 illustrates a hearing aid system for producing the aligned auditory perception according to an embodiment.

FIG. 2 illustrates a hearing aid system 100 for producing the aligned auditory perception according to an embodiment. This embodiment is same as the embodiment disclosed in FIG. 1, except that the first auditory unit 102 and the second auditory unit 104 share the same signal processor 110-112. The common signal processor 110-112 may be comprised in either the first auditory unit or the second auditory unit.

Figure 3:
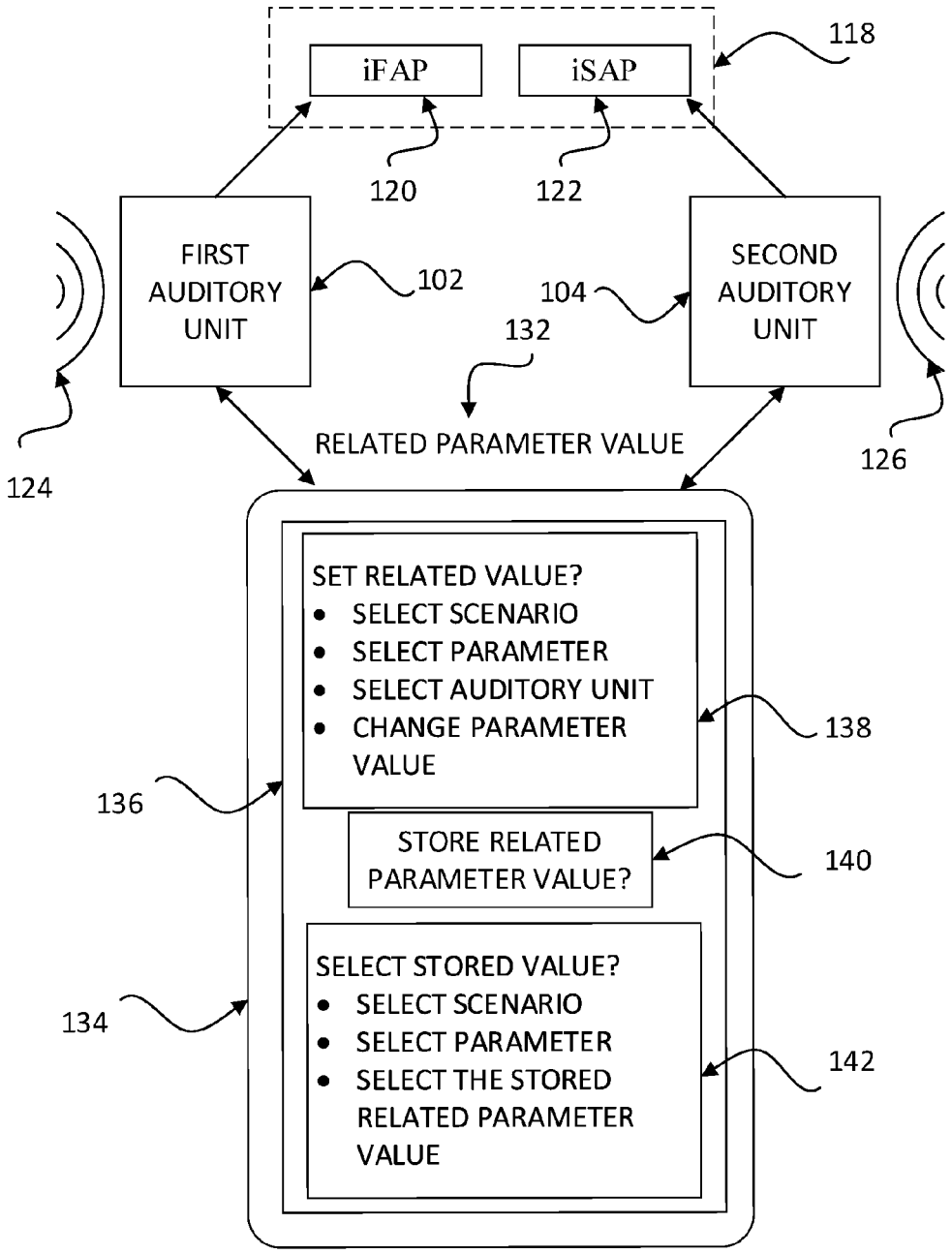
FIG. 3 illustrates a hearing aid system communicative coupled to a remote control according to an embodiment.

FIG. 3 illustrates a hearing aid system communicative coupled (either wired or wirelessly) to a remote control 134 according to an embodiment. The remote control, such as a smartphone running an application, is communicatively coupled with the first auditory unit 102 and/or with the second auditory unit 104. The remote control includes a user interface 136 configured to provide the user with provision for setting up 138 the related value for a parameter, storing 140 the set related parameter value and also selecting 142 an already stored related parameter value. In an embodiment, the setting of related parameter value includes manually selecting a scenario by a user based on user's identification of the scenario, selecting a parameter, selecting an auditory unit and changing parameter value for selected the auditory unit. The user may choose to save, using 140, the changed parameter value as related parameter value for future use.

The changed parameter is then stored in a look up table. In another embodiment 142, the user may obtain the aligned auditory perception by selecting a scenario, the remote control will offer related parameter value choices to the user that the user may choose from. The user may individually choose stored related parameter value 132 for each parameter for a specific scenario and the selected parameter value are then provided to the first auditory unit and/or the second auditory unit. Alternatively, the user only selects the scenario and all the related parameter values 132 for different parameters associated with the scenario are selected and provided to the first auditory unit and/or the second auditory unit via the communication link established with the first auditory unit and/or with the second auditory unit. In some situation, based on selection of the parameter, the remote control may automatically identify the auditory unit if the selected parameter is only associated with only one of the auditory units. In these embodiments, the related parameter value 132 provided using the remote control is then processed at the first auditory unit and/or second auditory unit the aligned auditory perception 118 is obtained.

Additionally or alternatively, the functioning of the remote control may be provided at the first auditory and/or the second auditory unit.

Figure 4:
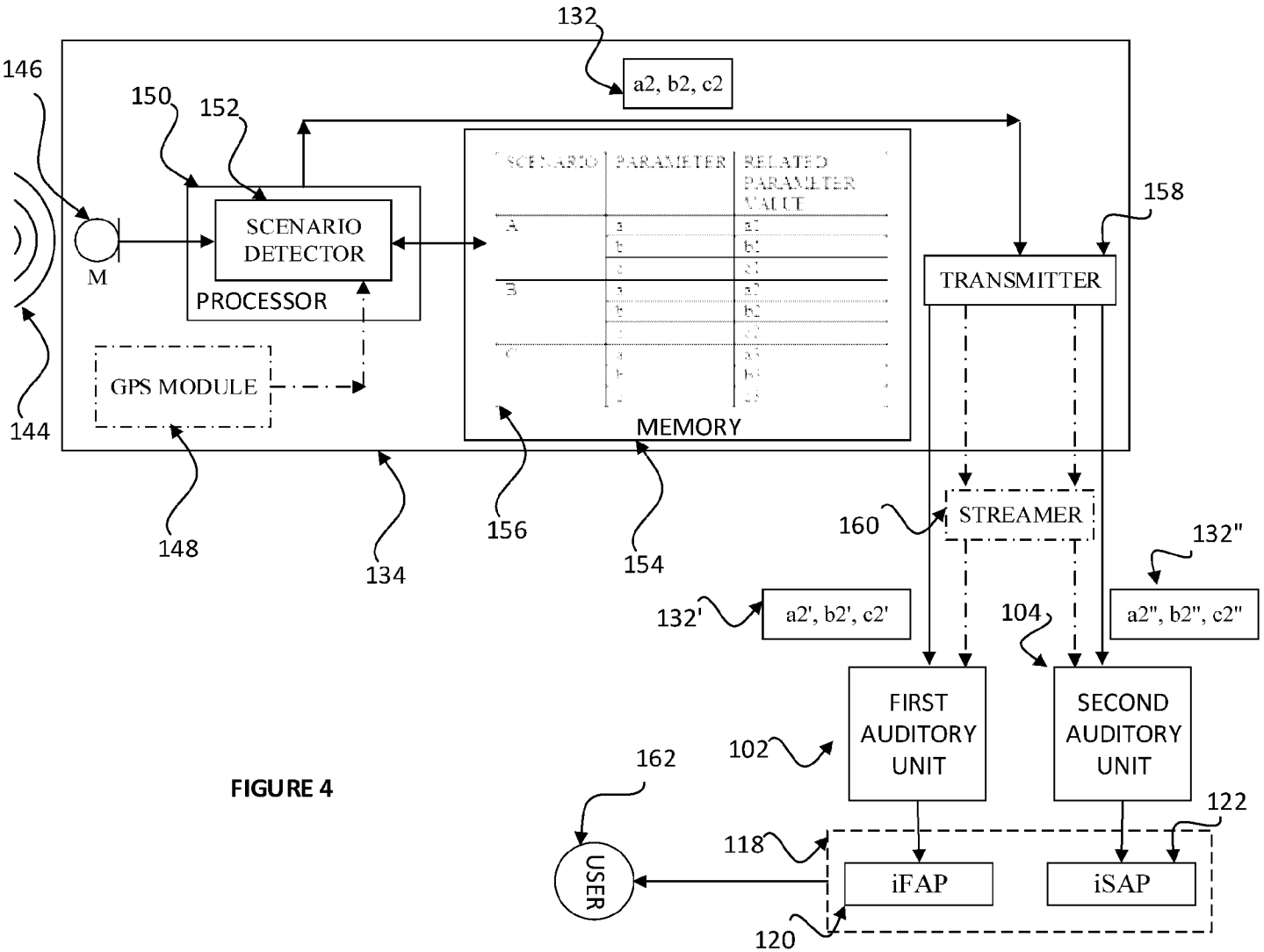
FIG. 4 illustrates a remote control configured to automatically align auditory perception according to an embodiment.

FIG. 4 illustrates a remote control 134 configured to automatically align auditory perception according to an embodiment. A microphone 146 of the remote control 134 is configured to pick up the sound 144 and to generate a microphone signal. The microphone signal relating to the picked up sound is provided to a scenario detector 152, which is comprised in a processor 150. Additionally or alternatively, the scenario detector 152 may receive microphone signals that are picked up by the microphone of the first auditory unit and/or the second auditory unit. This may provide a more accurate representation of the sound that is received by the user.

The scenario detector 152 includes circuitry to perform different types of analysis for example signal level estimation from the microphone signal, frequency component evaluation of the incoming microphone signal, etc. In one embodiment, a GPS module 148 of the remote control may provide location coordinates to the scenario detector. Based on the analysis and/or input from the GPS module, the scenario detector detects a scenario. The detection may include determining frequency components of the microphone signal, and/or level estimation of the incoming signal or of the frequency components of the incoming signal and/or geographic location of the user, etc. The scenario detector 152 is configured to access the look up table 156, which is stored in a memory 156 of the remote control. The detected scenario is compared with the scenarios stored in the look up table and relevant parameter values 132 relating to the matching scenario are utilized and transmitted to the first auditory unit and/or the second auditory unit. In the illustrated figure, scenario B is detected as the matching scenario and related parameter values a2, b2, c2 relating to the parameters a, b, c are transmitted using a remote control transmitter 158.

As discussed in earlier embodiments, the related parameter values may be transmitted only to the first auditory unit 102 or the second auditory unit 104. Alternatively, the first command may include a first part a2', b2', c2' (132') of the related parameter value transmitted to the first auditory unit 102. The second command may include a second part a2", b2", c2" (132") of the related parameter value transmitted to the second auditory unit. The first part is utilized to adjust the first parameter value by the first part of the related parameter value and the second part is utilized to adjust the second parameter value by the second part of the related parameter value. The first part of the related parameter and the second part of the related parameter value produces an effective adjustment that equals to the related adjustment produced by the related parameter value between the first parameter value and the second parameter value.

It is apparent that in an embodiment where the parameter relates only to one of the auditory units, then the related parameter value 132 is transmitted to the auditory unit with which the parameter is associated with. In this case, the processing of the related parameter value at the auditory unit receiving the related parameter value 132 modifies the output characteristics of the auditory unit such that the aligned auditory perception 118 is obtained.

In another embodiment, the first part and the second part is transmitted to the first auditory unit and the second auditory unit using an intermediary device 160. The intermediate device 160 may also be used to transmit the related parameter value either to the first auditory unit or to the second auditory unit instead of transmitting the first part and the second part.

Figure 5:
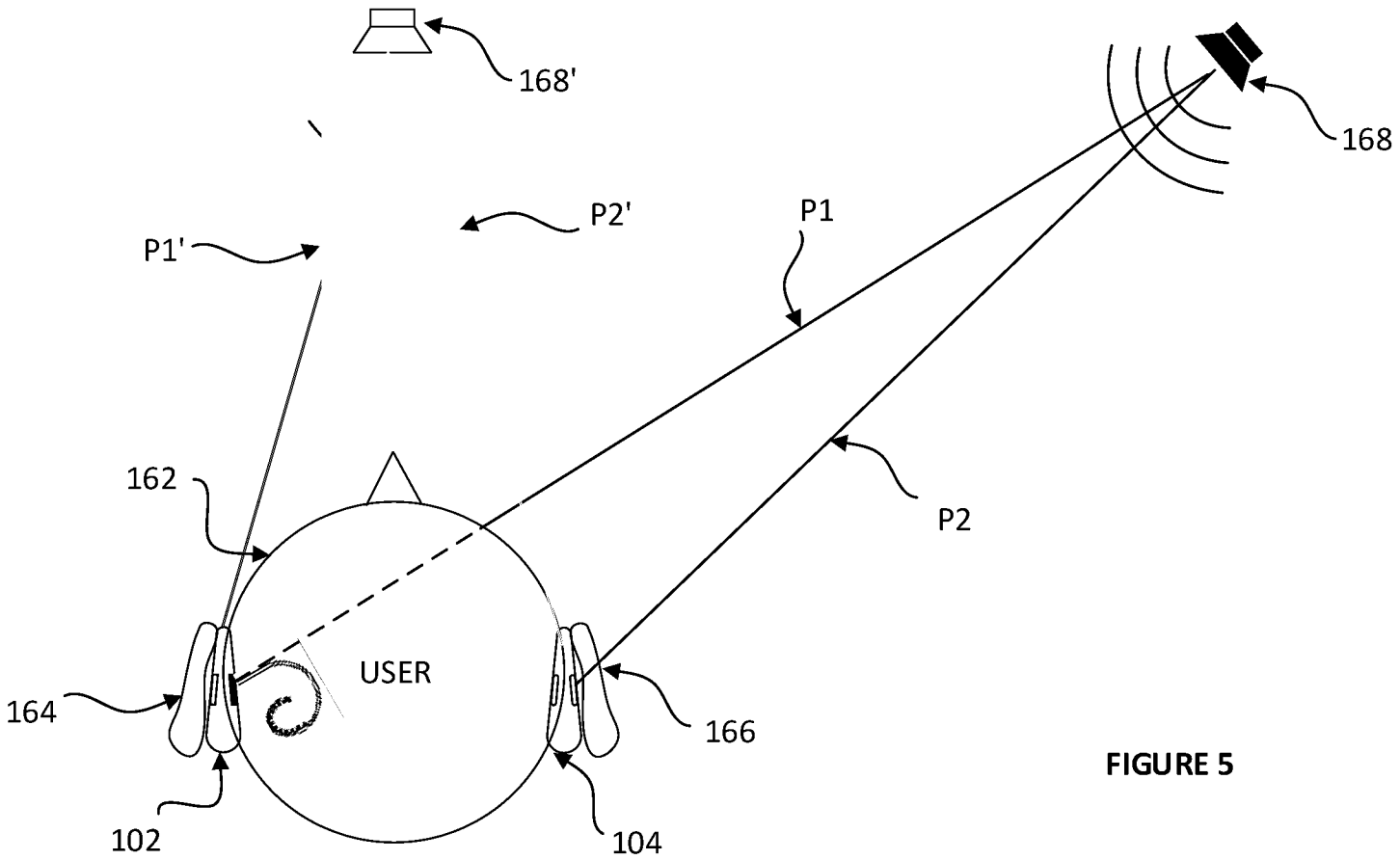
FIG. 5 illustrates scenarios for which a user may define related parameter values according to an embodiment.

FIG. 5 illustrates scenarios for which a user may define related parameter value according to an embodiment. The user may also define a scenario associated with the related parameter values, which may then become part of the look-up table. The embodiment illustrates the user wearing a cochlear implant 102 at a first ear 164 and a hearing aid 104 producing acoustic amplification at a second ear 166, such as in a bimodal stimulation. The user may perform self-adjustment test and define the related parameter value for a look up table. For example, in once scenario, a sound source 168 is positioned in a first spatial relationship with the cochlear implant 102 and the hearing aid 104 and a sound P1 is received at a microphone of the cochlear implant and a sound P2 is received at a microphone of the hearing aid. Using the sound source 168, the user may generate a sound having predefined level and frequency characteristics, the user using the remote control (FIG. 3, 134) may select different parameters and adjust the selected parameter value for the cochlear implant and/or hearing aid until the user feels/perceives that a good binuaral loudness balance and optimal binaural cue transmission between the first auditory perception and the second auditory perception is obtained. The user may change the level, and frequency characteristics of the sound generated by the sound source 168 and continue to define related parameter values for example in relation to parameter level and/or parameter frequency ranges, thereby obtaining a number of related parameter values for different levels and frequencies. The user may also change the spatial positioning of the sound source 168' in relation to the cochlear implant 102 and the hearing aid 104 and define further related parameter values for the sound P1' and P2'. The defined related parameter values are then stored in the look-up table and are made available for future use, as explained in relation to the FIG. 4.

In this illustrative example of bimodal stimulation, the user may perceive that in absence of using the related parameter value, the sound source localization is not satisfactory. One of the reasons being the auditory units in the bimodal stimulation have different processing delays, leading to temporal asynchrony between the ears. When a sound arrives at the microphone of the cochlear implant sound processor, it is subjected to a device-dependent and frequency dependent processing delay which is defined as the time between the initial deflection of the diaphragm of the microphone of the sound processor and the corresponding first pulse presented on an electrode. Subsequently, processed signals are decoded by the implanted chip where they may be subjected to an additional short processing delay. Finally, the auditory nerve is directly electrically stimulated. By comparison, when a sound arrives at the microphone of an hearing aid, it also undergoes a processing delay. Then the sound produced by the hearing aid receiver travels through the middle and inner ear before finally stimulating the auditory nerve. The total delay is therefore the sum of the device's processing delay and the frequency-dependent travelling wave delay. It is clear that in most cases the total delay of the electric and acoustic path will differ, such that the neural stimulation occurs first at the side with the shorter processing delay. In order to overcome reduced perception of sound localization because of varied processing delay, the user may add a delay, such as a frequency dependent delay, to the faster device, where processing time may be considered as a parameter and the delay as the related parameter value. Although, the description is provided in relation to the bimodal stimulation but this principle is applicable in other combinations as well.

In another example of sound source localization two binaural cues: interaural level differences (ILDs) and interaural time differences (ITDs) become important. Good ITD perception depends on consistent ILD cues or at least loudness balance between the ears. For ILD cues to be properly transmitted, loudness growth needs to be similar at the two sides. ILDs are caused by the head-shadow effect, which is the attenuation of sound due to the acoustic properties of the head. Because of the size of the head relative to the wavelength of sounds, ILD cues are mainly present at higher frequencies (Hz). Therefore, the user may provide a related parameter value comprising frequency dependent level adjustment between a first level of the first auditory perception and a second level of the second auditory perception such that the loudness balance for specific scenario such as frequency/frequency range is achieved, thereby providing the aligned auditory perception.

In view of the aforementioned examples, the skilled person would appreciate that many other adjustments are also possible and within the scope of this disclosure.

Figure 6:
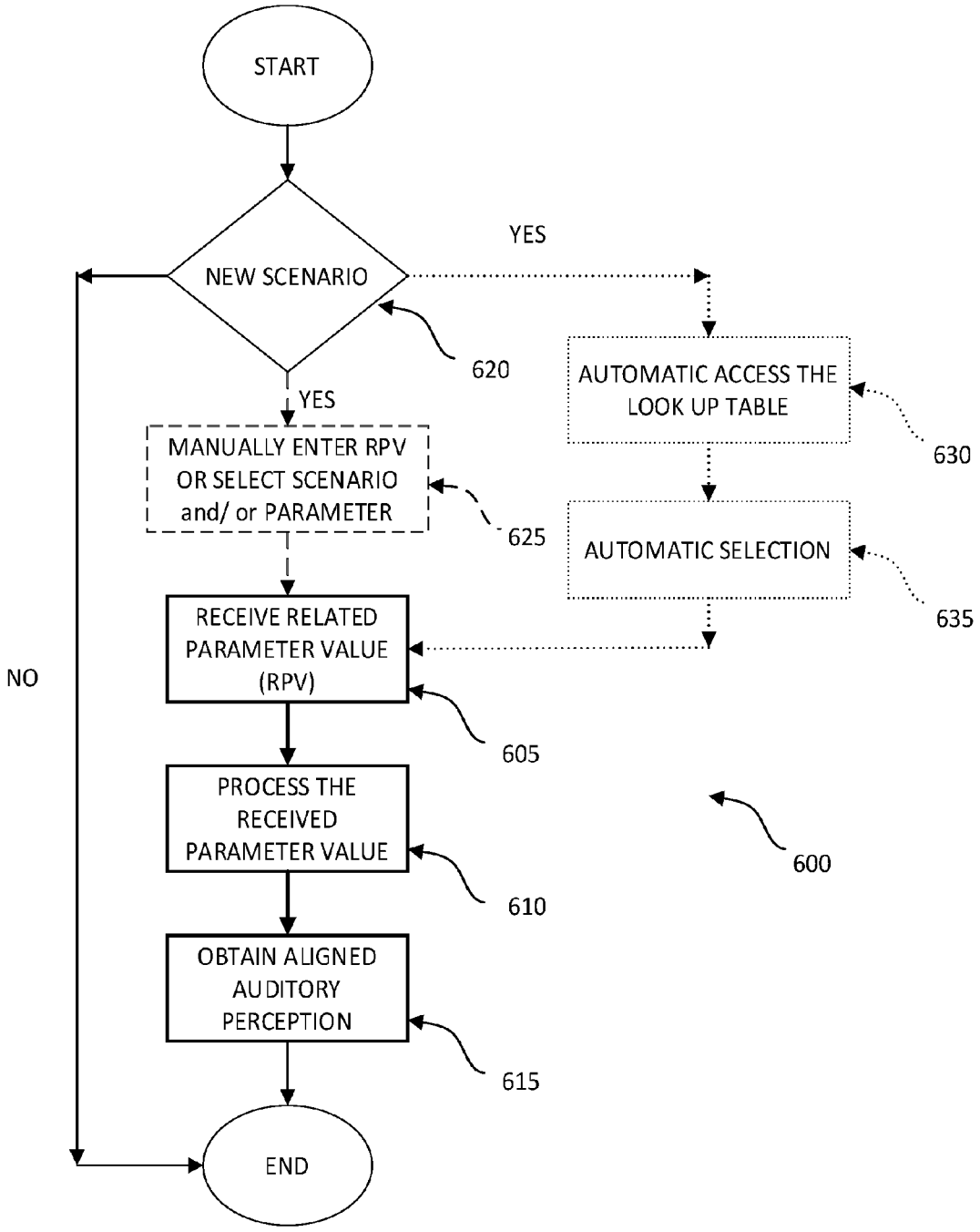
FIG. 6 illustrates a method for operating a hearing aid system according to different embodiments.

FIG. 6 illustrates a method 600 for operating a hearing aid system according to different embodiments. In one embodiment, at 605 the related parameter value is received at the first auditory unit and/or the second auditory unit. The first auditory unit and/or the second auditory unit at 610 processes the received related parameter value and generates at 615 the aligned auditory perception. Additionally, at 620 a determination may be made, either manually or automatically, whether the scenario is new.

Thereafter, in one embodiment, at 625 the user may manually enter the related parameter value or select the related parameter value from the look up table or select a pre-stored scenario, such selection of the scenario automatically selects the associated related parameter values. At 605, the first auditory unit and/or the second auditory unit receives the selected parameter value or the related parameter values associated with the scenario and at 610, processes the received related parameter value to obtain the aligned auditory perception at 615.

In another embodiment, after automatically determining the new scenario at 620, the look up table is automatically accessed at 630. Thereafter, at 635 at least one related parameter value associated with the determined scenario or the pre-stored scenario is automatically selected. The selection of the scenario automatically selects all the associated related parameter values. At 605, the first auditory unit and/or the second auditory unit receives the selected parameter value or the related parameter values associated with the scenario and at 610, processes the received related parameter value to obtain the aligned auditory perception at 615.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, steps, operations, elements, and/or components, but do not preclude the presence or addition of one or more other features, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

We claim:

1. A hearing aid system comprising:

a first auditory unit configured to be worn by a user and providing a first auditory perception to the user, the first auditory unit utilizing a first working principle;

a second auditory unit configured to be worn by the user and providing a second auditory perception to the user, the second auditory unit utilizing a second working principle, wherein the first auditory unit and/or the second auditory unit are configured to process a related parameter value for a parameter, received from the user, such that an aligned auditory perception between the first auditory perception and the second auditory perception is obtained, the related parameter value defines a relative adjustment between a first parameter value associated with the first auditory perception and a second parameter value associated with the second auditory perception; or an adjustment of the parameter value of the auditory unit associated with the parameter where the parameter is only associated with one of the auditory units, and the first working principle and the second working principle are selected from a group consisting of electrical stimulation, mechanical stimulation, acoustic stimulation, optical stimulation, and a combination thereof.

2. The hearing aid system according to claim 1, wherein the first working principle and the second working principle are same, or the first working principle and the second working principle are different.

3. The hearing aid system according to claim 1, wherein the first working principle and the second working principle are partially different.

4. The hearing aid system according to claim 1, wherein the first auditory unit and the second auditory unit are worn at different ears of the user.

5. The hearing aid system according to claim 1, wherein the first auditory unit is configured to receive a first command from the user and to process the first command; and/or the second auditory unit is configured to receive a second command from the user and to process the second command; and/or a remote control, in a communicative link with the first auditory unit and/or second auditory unit, is configured to receive the first command and/or second command from the user and to transmit the first command and/or second command to the first auditory unit and/or second auditory unit respectively; wherein the processing of the first command and/or second command generates the aligned auditory perception.

6. The hearing aid system according to claim 5, wherein the first command comprises the related parameter value and a first instruction set adapted to be executed by a signal processing unit associated with the first auditory unit, the execution of the first instruction set adjusts the first parameter value of the parameter with respect to the second parameter value by the related parameter value; or the second command comprises the related parameter value and a second instruction set adapted to be executed by a signal processing unit associated with the second auditory unit, the execution of the second instruction set adjusts the second parameter value of the parameter with respect to the first parameter value by the related parameter value; or the first command comprises a first part of the related parameter value and a first instruction set adapted to be executed by a signal processing unit associated with the first auditory unit and the second command comprising a second part of the related parameter value and a second instruction set adapted to be executed by a signal processing unit associated with the second auditory unit, the execution of the first instruction set adjusts the first parameter value of the parameter by the first part of the related parameter value and the execution of the second instruction set adjusts the second parameter value of the parameter by the second part of the related parameter value such that an effective adjustment produced by the first part of the related parameter value and the second part of the related parameter value equals to the related adjustment produced by the related parameter value between the first parameter value and the second parameter value.

7. The hearing aid system according to claim 1, wherein the parameter comprises features that characterize performance of the first auditory unit and the second auditory unit, the features being capable of influencing localization ability and/or speech recognition from an audio signal.

8. The hearing aid system according to claim 1, wherein the related parameter value is established for different scenarios selected from a group consisting of different sound environment, different locations, different events, different audio frequencies, different audio frequency ranges, and a combination thereof.

9. The hearing aid system according to claim 1, wherein the processing unit associated with the first auditory unit and/or second auditory unit and/or the remote control is adapted to generate a look-up table comprising a mapping between a scenario and a related parameter value for at least one parameter.

10. The hearing aid system according to claim 1, wherein the first auditory unit comprises a first memory and/or second auditory unit comprises a second memory and/or the remote control comprises a remote memory, the first memory and/or the second memory and/or the remote memory being configured to store the look up table.

11. The hearing aid system according to claim 1, wherein a processing unit associated with the first auditory unit and/or the second auditory unit and/or the remote control is configured to detect a scenario for the first auditory unit and the second auditory unit;

access, in response to the detected scenario, the stored related parameter value from the look-up table, and adjust, utilizing the accessed related parameter value, the first parameter value relative to the second parameter value for a parameter such that the aligned auditory perception is obtained or adjust the parameter value of the auditory unit associated with the parameter where the parameter is only associated with one of the auditory units.

12. A method for operating a hearing aid system, the method comprising:

receiving a related parameter value for a parameter at a first auditory unit and/or a second auditory unit, the first auditory unit utilizing a first working principle, the second auditory unit utilizing a second working principle; and processing the received related parameter value at the first auditory unit and/or the second auditory unit such that an aligned auditory perception between a first auditory perception produced by the first auditory unit and a second auditory perception produced by the second auditory unit is obtained, wherein the related parameter value defines a relative adjustment between a first parameter value associated with the first auditory perception and a second parameter value associated with the second auditory perception or an adjustment of the parameter value of the auditory unit associated with the parameter where the parameter is only associated with one of the auditory units, and the first working principle and the second working principle are selected from a group consisting of electrical stimulation, mechanical stimulation, acoustic stimulation, optical stimulation, and a combination thereof.

13. The method according to claim 12, wherein the received related parameter is received based on manual input from a user or automatically in dependence on access of the related parameter value from a look up table based on scenario detection.

14. The method according to claim 12, wherein the first working principle and the second working principle are same, or the first working principle and the second working principle are different.

15. The method according to claim 12, wherein the first working principle and the second working principle are partially different.

* * * * *